US007758208B2

(12) United States Patent
Bailey

(10) Patent No.: US 7,758,208 B2
(45) Date of Patent: Jul. 20, 2010

(54) MULTI-PRIMARY LED COLLIMATION OPTIC ASSEMBLIES

(75) Inventor: Edward Bailey, Westampton, NJ (US)

(73) Assignee: Lighting Science Group Corporation, Satellite Beach, FL (US)

( * ) Notice: Subject to any disclaimer, the term of this patent is extended or adjusted under 35 U.S.C. 154(b) by 376 days.

(21) Appl. No.: 11/964,523

(22) Filed: Dec. 26, 2007

(65) Prior Publication Data

US 2009/0168414 A1 Jul. 2, 2009

Related U.S. Application Data

(60) Provisional application No. 60/871,581, filed on Dec. 22, 2006.

(51) Int. Cl.
*F21V 9/00* (2006.01)

(52) U.S. Cl. ..... 362/231; 362/234; 362/235

(58) Field of Classification Search ..... 362/242, 362/243, 244, 245, 268, 311.11, 311.12, 362/327, 330, 332, 336, 339, 231, 247, 272, 362/16; 359/641, 619–628; 313/512
See application file for complete search history.

(56) References Cited

U.S. PATENT DOCUMENTS

| | | | | |
|---|---|---|---|---|
| 2,604,002 | A * | 7/1952 | Wengel | 396/385 |
| 3,522,424 | A * | 8/1970 | Fritsch | 362/268 |
| 4,930,864 | A * | 6/1990 | Kuster et al. | 359/350 |
| 5,245,481 | A | 9/1993 | Kaneko et al. | |
| 6,478,453 | B2 * | 11/2002 | Lammers et al. | 362/294 |
| 6,560,038 | B1 | 5/2003 | Parkyn, Jr. et al. | |
| 6,611,382 | B2 * | 8/2003 | Hashimoto | 359/619 |
| 6,637,924 | B2 | 10/2003 | Pelka et al. | |
| 7,006,306 | B2 | 2/2006 | Falicoff et al. | |
| 7,198,376 | B2 * | 4/2007 | Katsumata et al. | 353/102 |
| 2002/0067549 | A1 | 6/2002 | Tawa et al. | |
| 2004/0070841 | A1 | 4/2004 | Bierhuizen | |

OTHER PUBLICATIONS

PCT International Preliminary Report on Patentability for International Application No. PCT/US2007/088812; International Filing Date: Dec. 26, 2007; Date of Mailing: Jul. 2, 2009.

* cited by examiner

*Primary Examiner*—Sandra L O'Shea
*Assistant Examiner*—Danielle Allen
(74) *Attorney, Agent, or Firm*—Cantor Colburn LLP

(57) ABSTRACT

The present invention relates to an optical assembly which improves color uniformity and improved collimation of light produced by multiple LED light sources in a light engine. The optical assembly is specifically tailored to match the placement of the solid-state emitters making up the light engine or light producing element. Specifically, a shaped free-form spline patch inner collimation lens having an optimized cross-sectional shape and micro-ridges is used to disperse light; multi-lobe TIR collimation lens having an optimized cross-sectional shape and micro-ridges is used to disperse and redistribute phase as well as provide collimation; primary mixing lenslet array having an optimized surface is used to disperse light from the light emitter; a spline profile reflector further mixes and collimates the light; a secondary lenslet array further mixes the light; and a secondary collimation lens further collimates the light.

25 Claims, 19 Drawing Sheets

Figure 4B
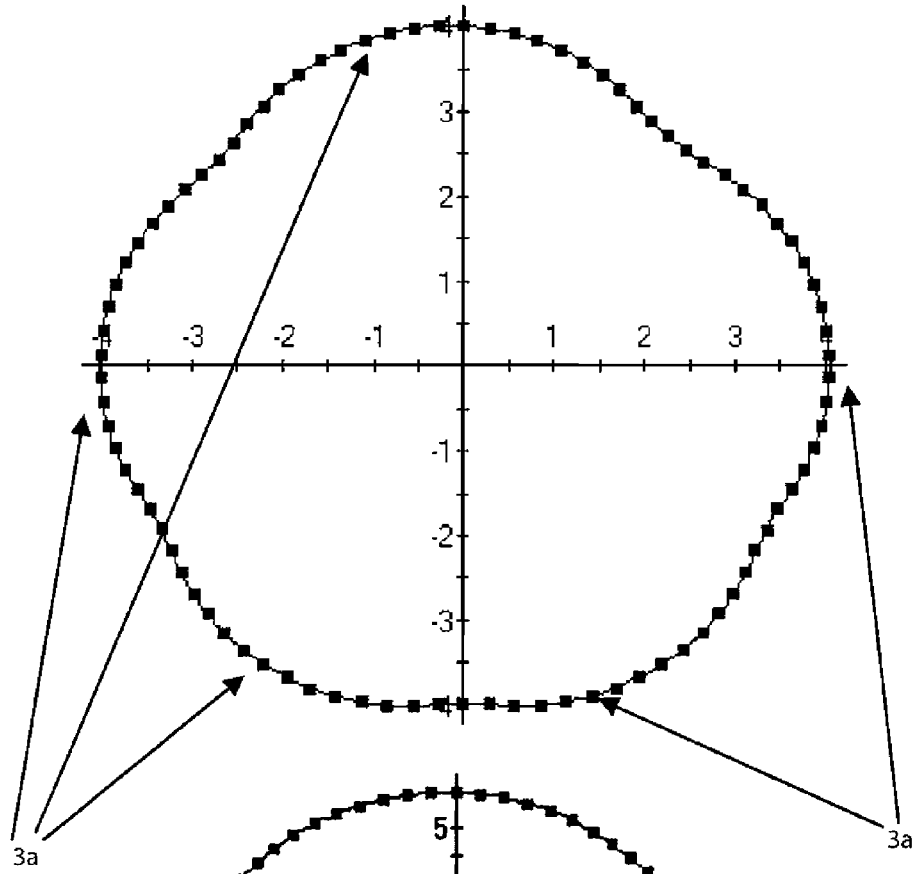
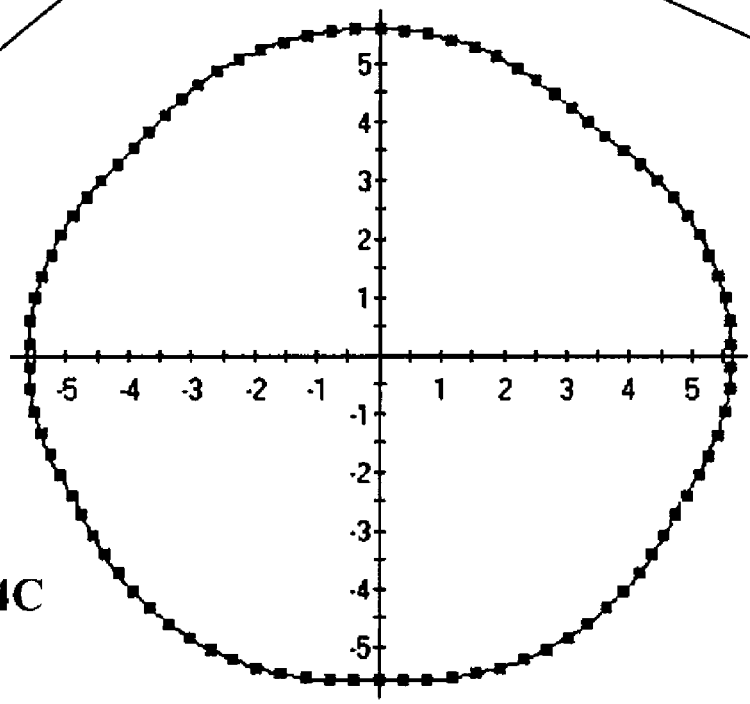
Figure 4C

Figure 4D
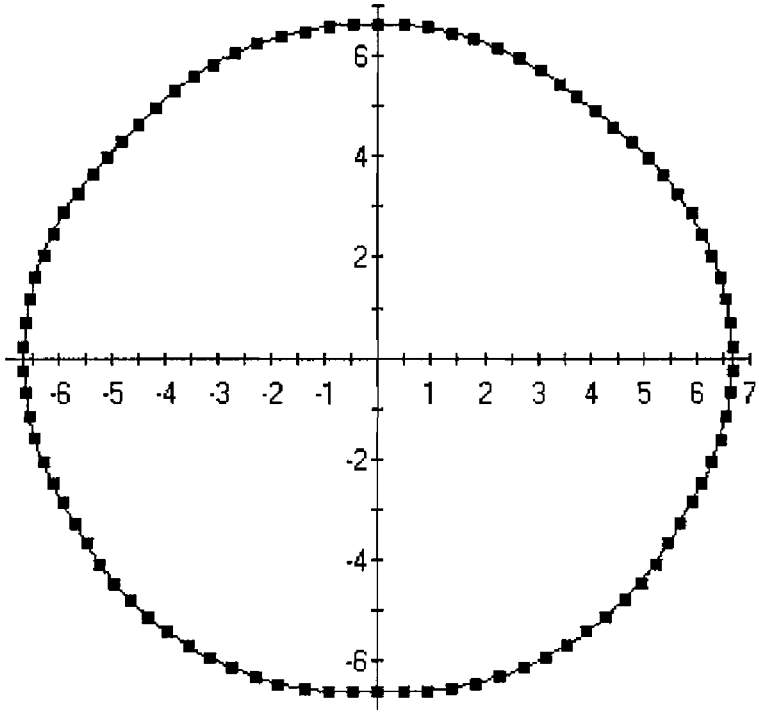
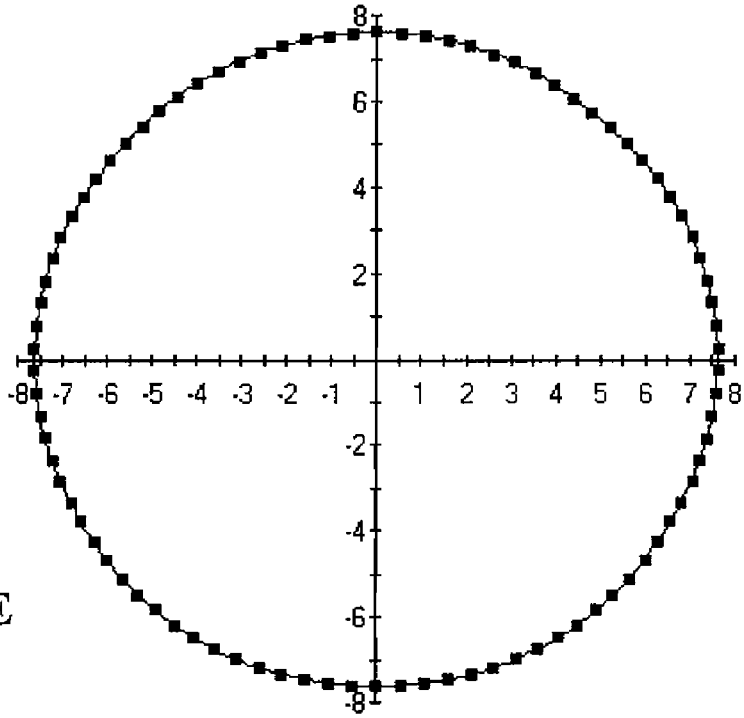
Figure 4E

MULTI-PRIMARY LED COLLIMATION OPTIC ASSEMBLIES

This application claims priority from U.S. Provisional Patent Application No. 60/871,581, the entire content of which is hereby incorporated by reference in its entirety.

Numerous references including various publications may be cited and discussed in the description of this invention. The citation and/or discussion of such references is provided merely to clarify the description of the present invention and is not an admission that any such reference is "prior art" to the present invention. All references cited and discussed in this specification are incorporated herein by reference in their entirety and to the same extent as if each reference was individually incorporated by reference.

FIELD OF THE INVENTION

This invention relates to optical devices. More specifically, the present invention relates to multicolor optical light source assemblies that produce an emitted light collimated to a narrow beam, while achieving acceptable color uniformity.

BACKGROUND OF THE INVENTION

Certain industries, for instance the entertainment, architectural or theater industries, have applications for specialized lighting which can benefit from an apparatus or system which is able to produce colors selected from among a palette of an extremely large number of colors, and which is able to control the direction at which the light is projected. A palette having millions of colors is useful for applications such as light painting, product enhancement, and special effects.

The color of light emitted from a light source is determined by its spectral properties. The spectrum can be duplicated by a weighted sum of the additive primary colors red, blue and green. A single color can be produced by an individual light emitting diode (LED), the color being either a primary color or a color which is a composite of more than one primary color. LEDs can be produced having a variety of colors. A composite emitted light can be made by grouping LEDs of various combinations of colors in close physical proximity, with each LED individually emitting at a selectable intensity. The LEDs may also be placed in a reflective cavity that is shaped to enhance control over the direction of the composite light. The composite light may be used, for instance, for artistic, theatrical, or display purposes. However, light from the individual LEDs historically has been difficult to collimate to a narrow beam, thereby producing a composite light having poor color uniformity. Collimation and beam width are related terms, in which a highly collimated beam necessarily is a beam that has a narrow beam width compared to a beam that is not highly collimated.

A directed light beam is light emitted in a preferred direction, and can be characterized by beam angle and dispersion. Beam angle refers to the full beam dispersion angle at half the maximum on-axis luminous intensity. Intensity dispersion is a measure of the distribution of light over an angle with respect to the center of the light beam. Specialized lighting applications such as those identified above can benefit from having the ability to project a directed light beam of a composite of colors over a long distance. The distance of projection is increased when the emitted light is concentrated into a small beam angle.

FIG. 1 is a top view of LED placement locations within a conventional light engine cavity, in which "B" indicates a blue excitation emitter with wavelength 440-495 nm, "R" indicates a direct emission red, orange, or amber with wavelength range 575-680 nm, and "G" indicates a direct emission green wavelength having a range 495 nm-575 nm. The LEDs are typically mounted on a substrate 1 which provides electrical connections, thermal dissipation, and mechanical support.

LED spacing within the light engine limits the minimum distance at which the light engine can be located from the target of its illumination, because too small a distance from the target of illumination produces poor composite color uniformity illumination of a close-in target. Typical spacing between the individual LEDs is approximately 0.2032 millimeters as shown but may vary by as much as ±0.5 mm or more. Color mixing improves as LED spacing is reduced, but equipment or speed of manufacture limit how close together the LEDs may be placed, causing conventional multi-colored light engines like that shown in FIG. 1 to suffer from poor color mixing.

Light engines are designed with the LEDs spaced relatively widely apart for improved heat dissipation, thereby causing poor color mixing. Viewers may see the poor color mixing as changes in the perceived light color from the light engine when viewed from different viewing angles. Optical devices for controlled color mixing developed by the applicant are known and described in commonly-assigned U.S. patent application Ser. No. 11/737,101, the entire content of which is incorporated by reference herein in its entirety. Second, fabrication machines and techniques may limit the minimum distance the LED die can be placed on the substrate.

Light from an emitter like that of FIG. 1 is conventionally passed through a rotationally-symmetric passive optic collimator in order to control the direction of light rays emitted by the engine. FIG. 2 is an illustration of the close-in beam illuminance pattern resulting from passing the light emitted by the light engine of FIG. 1 through a rotationally symmetric total internal reflection (TIR) secondary optical lens. The illuminated area does not have the desired uniformity of illumination, but instead has multiple colors illuminated. The red, green and blue primary colors emitted by the individual LEDs are focused in different locations in the field. The area of poor color uniformity may include any non-desired combination of colors emitted by the individual LEDs, and may be in any portion of the illuminated area, and the region may be of any shape. This separation of the colors is not desirable for some applications.

The conventional solutions to collimating multi-primary emitters produce a more homogeneous color uniformity at the expense of a wider beam width, and therefore the conventional solutions cannot separately and simultaneously optimize both color uniformity and beam width. In addition, for some lighting applications, e.g., entertainment applications, there is a need to "throw" or project a selected color at a screen or surface at a distance of ≧15 meters while maintaining an acceptable level of illumination and color uniformity. High illuminance at a long throw distance requires a narrow beam. Light intensity dispersion must be minimized in order to maximize the throw distance. Therefore, a need exists to provide an optics assembly which can simultaneously optimize the collimation and color uniformity of a light beam produced by a light engine.

SUMMARY OF THE INVENTION

Multi-primary LED collimation optic assemblies are presented which are able to produce a light beam having improved collimation and color uniformity compared to conventional assemblies. Light emitted by the LEDs passes through an optical assembly which may include the optical features of a spline patch inner lens, at least two lenslet arrays, a rippled reflector, and at least one secondary collimation lens. The spline patch inner lens, TIR lens and at least one lenslet array are shaped to match the placement of the LEDs within the light engine. Surface details of the optical components improve the collimation, efficiency and color uniformity of the light passing through the light guide. A second embodiment of the optical assembly includes a ribbed light guide and a collimation reflector.

A device in accordance with an embodiment of the present invention preferably includes one or more of the following assembly design features or functions:

1) multi-lobe TIR lens;

2) free-form spline patch inner lens, each shaped as a Nonuniform Rational B-Spline, "NURBS";

3) spiral hex or randomized primary lenslet structure;

4) secondary lens with aspheric polynomial surface or Zernike control surface for collimation;

5) secondary lenslet array;

6) ribbed light guide to increase color uniformity of multi-primary light engine;

7) secondary spiral hex or random lenslet array;

8) secondary collimation lens with aspheric profile;

9) tertiary lenslet array if necessary.

The combined effect of both collimation and color uniformity enhancement features are preferred for improved intensity with high uniformity. For example, removing the secondary reflector will degrade luminous intensity. Removing ridges on the light guide or the reflector will degrade spatial illuminance uniformity at the exit aperture of the light guide. Removing the secondary aspheric lens will result in a flood rather than a spot beam which is more desirable for some applications. Certain optical features are interrelated, such that one optical feature may be improved at the cost of a degradation to another optical feature, e.g., uniformity can be degraded to obtain higher collimation, or optical transfer efficiency can be degraded to produce higher color uniformity. The combinations of color uniformity enhancement and collimation features and the specific order in which they are used determine the overall performance of the optical system.

BRIEF DESCRIPTION OF THE DRAWINGS

Embodiments of the present invention will be more readily understood from the detailed description of exemplary embodiments presented below considered in conjunction with the accompanying drawings, in which:

FIGS. 4B-4F present cross-sectional views of the multi-lobe collimation TIR lens, in the X-Y plane at various heights in the Z axis, indicating multiple lobes and profiles.

DETAILED DESCRIPTION OF THE INVENTION

Figure 1:
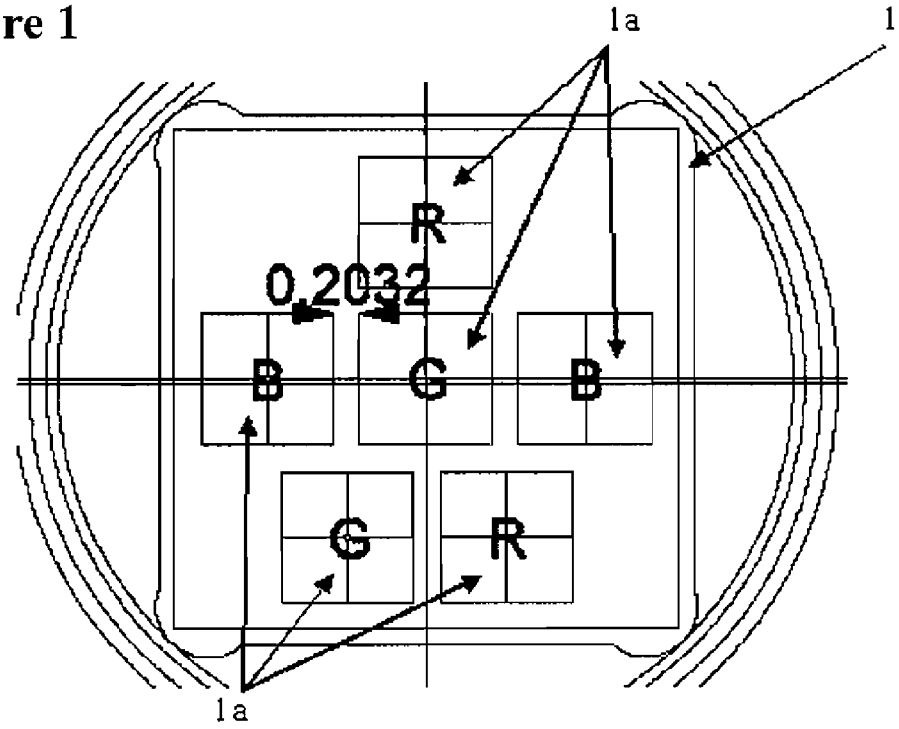
FIG. 1 is a top view of LED placement locations within a conventional light engine cavity.
Figure 2:
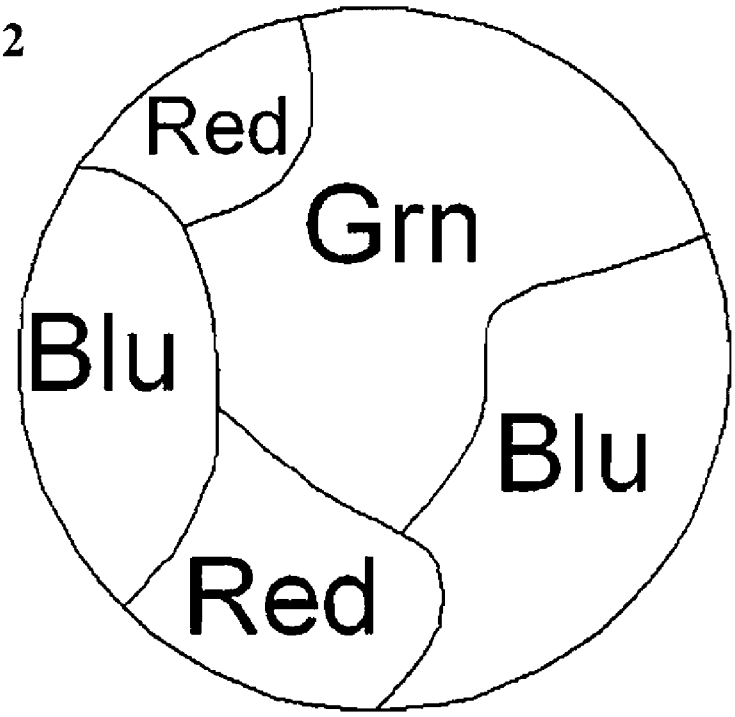
FIG. 2 is a beam pattern as projected on an observation screen resulting from rotationally symmetric TIR optics.

Traditional LED optics are rotationally symmetric and do not produce a light beam having narrow collimation, nor a light beam having sufficient color uniformity for some applications. The present invention is directed to an optical assembly which performs the dual function of collimation and color homogenization or mixing. The optical assembly disclosed is specifically tailored to match the placement of the solid-state emitters making up the light engine or light producing element. Preferably, the light engine is the 6-LED assembly shown in FIG. 1. The red LEDs are driven with 4.8 volts/0.35 amperes; green LEDs are driven with 7.4 volts/0.35 amperes; and blue LEDs are driven with 7.9 volts/0.35 amperes. The individual LEDs produce a relatively wide lambertian 130° beam angle.

Figure 3:
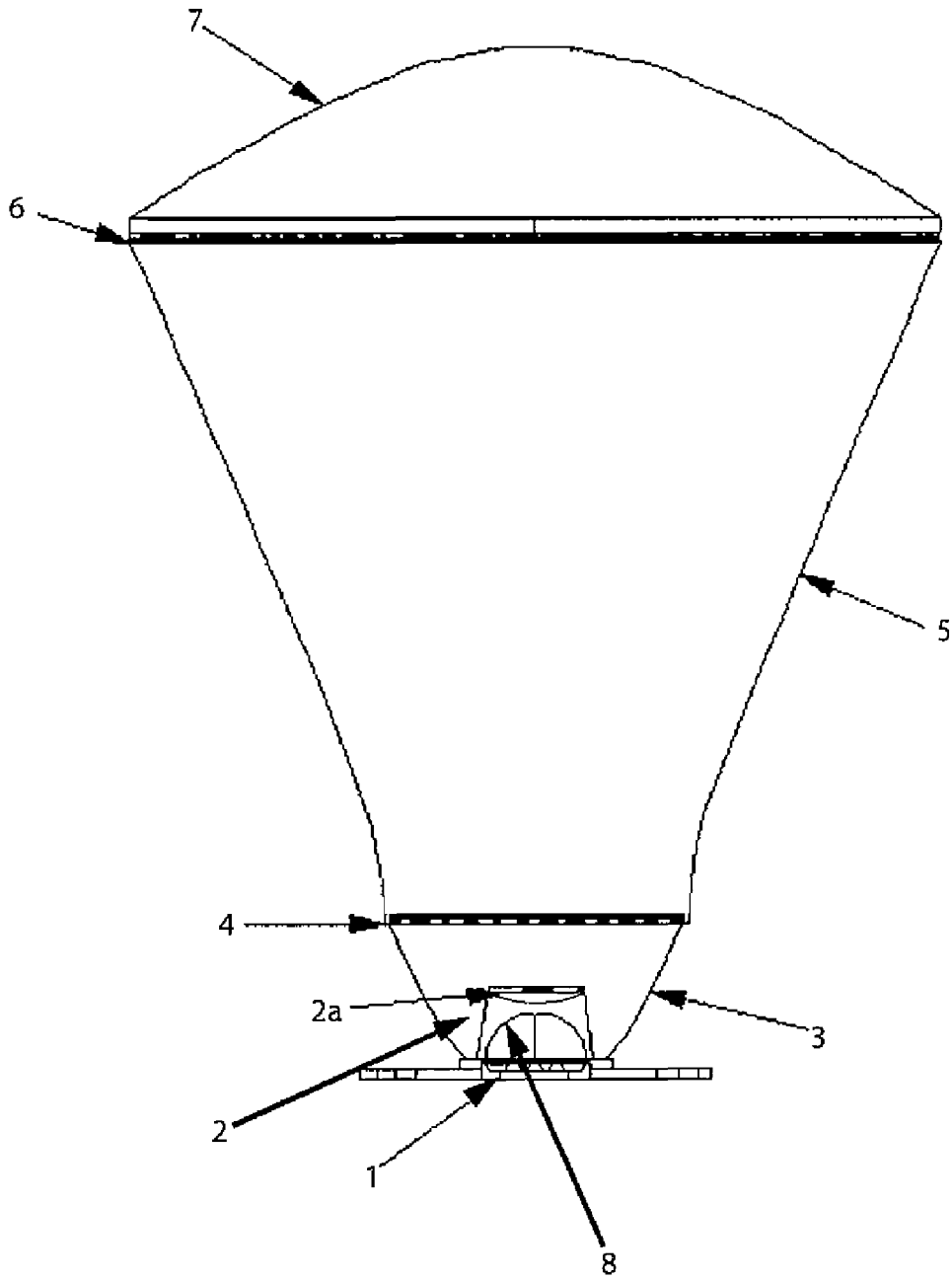
FIG. 3 is a side view of a first embodiment of the optic assembly.

FIG. 3 shows a first embodiment of the entire assembly, having the following features designed to enhance the collimation and mixing of light, with each of these features discussed in greater detail below: light engine 1 having a plurality of LEDs; LED light extraction lens 8; transmissive inner spline wall 2; free-form spline patch inner collimation lens 2*a*; multi-lobe TIR collimation lens 3; primary mixing lenslet array 4 fabricated in a primary mixing lenslet array body; b-spline profile reflector 5; secondary lenslet array 6; secondary collimation lens 7. The light engine 1 has a plurality of LEDs and is preferably the light engine shown in FIG. 1.

Figure 4A:
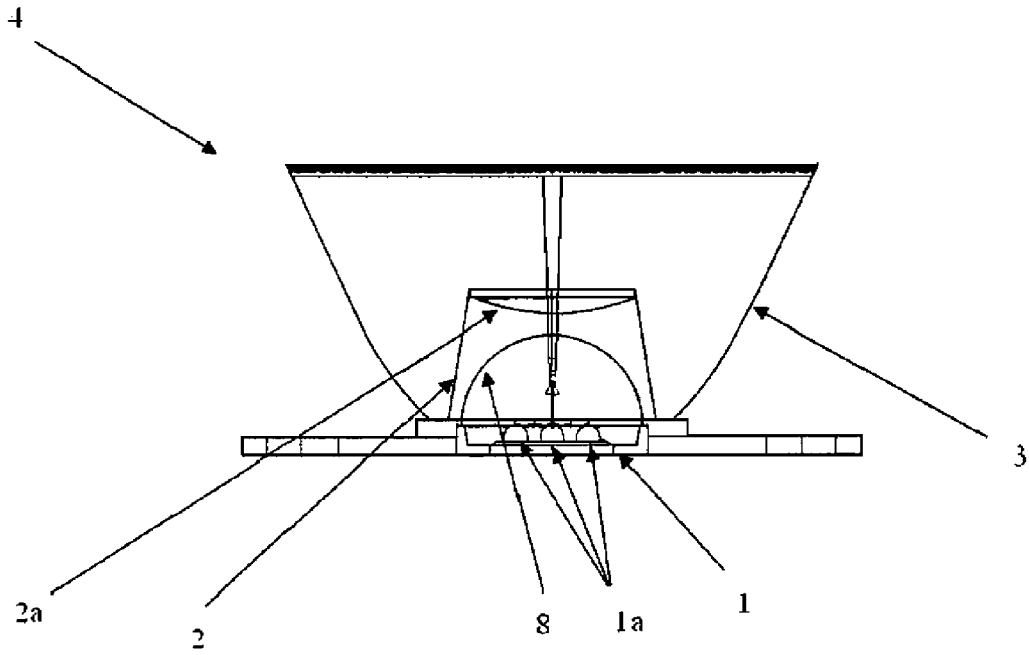
FIG. 4A is a side view in the Z-X plane of a multi-lobe collimation TIR lens.
Figure 4F:
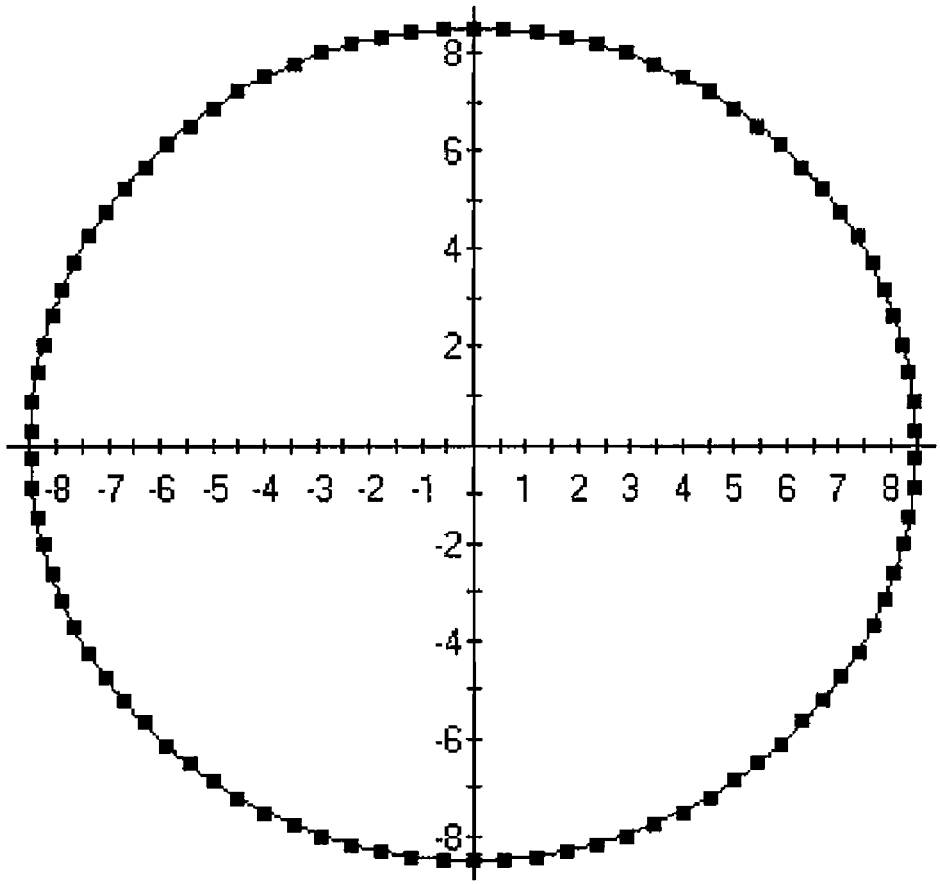

FIG. 4*a* is an expanded view of the bottom portion of FIG. 3, showing the portion of the assembly where the light is generated and initially controlled. The light engine 1 in FIG. 4*a* is shown in a side view with three LEDs 1*a* visible. The light initially passes through a light extraction lens 8 which is generally a convex dome structure encapsulating the LEDs, made of a glass or high index silicone material which aids the transfer efficiency of the light from the LED and light extraction lens to the air. A silicone encapsulant aids the extraction of light from the high index LED semiconductor.

Refracted light rays emerging from the light extraction lens 8 that have a ±30° or less angle between their direction of travel and the Z-axis encounter a free-form spline patch inner collimation lens 2*a* ("spline patch lens"), in which "free-form" refers to a lens which lacks a center of rotation and having a surface described as a general surface polynomial or b-spline surface. The spline patch lens 2*a* acts to improve the collimation and color uniformity of the light. The cross-sectional shape of the spline patch lens 2*a* is tailored to the specific layout of LEDs within the light engine, for instance the light engine shown in FIG. 1. Tailoring refers to the guidance of light, which originated from extended sources at specific spatial locations, the sources having a prescribed emission intensity distribution, by the means of refractive, reflective, or diffractive means. Tailoring can include three dimensional redirection of light paths, for the purpose of collimating or redistributing light to improve uniformity. Light tailoring is performed through Monte-Carlo raytracing using extended sources. Discovery of the preferred shape of the spline patch lens 2*a* or wall of multi-lobe TIR collimation lens 3 is performed through repeated perturbation of the surface shape of the spline patch lens 2*a* or profiles of the collimation lens 3 at a section in Z, calculation of the merit function and repeating this process with a slightly perturbed shape of spline patch lens 2*a* or wall of multi-lobe TIR collimation lens 3, until a shape is found having a sufficiently high merit function in which the merit function includes both collimation and uniformity elements. Merit functions are described in E. Bailey, *Narrow Beam RGB Array Optic*, Proceedings of the SPIE, Volume 6669, pp. 666917 (2007), the entire content of which is hereby incorporated by reference in its entirety. The resulting spline patch lens 2*a* and multi-lobe TIR collimation lens 3 provide improved collimation of the light through refraction. The spline patch lens 2*a* has a vertical cross-sectional shape of a spline, for instance a Bezier curve or b-spline. A b-spline surface can be described by:

$$S(u, v) = \sum_{i=1}^{n} \sum_{j=1}^{m} N_i^k(u_i) N_j^l(v_j) P_{i,j}$$

Where S(u,v) is the b-spline surface defined by an array of control points in the u and v directions in which k and l are the orders of the b-spline surface in both directions, and P contains an array of control points in which n represents the index of the control point in the u direction and m the index of the control point in the v direction $N_i^k(u_i)$ defines the polynomial b-spline spline basis function of degree i through k in the u direction whereas $N_j^l(v_j)$ are the basis functions of degree j through l in the v direction. B-spline patch control points $U_1$-$U_3$ and $V_1$-$V_3$ are given by:

| | $U_1$ | $U_2$ | $U_3$ |
|---|---|---|---|
| $V_1$ | −1.1957 | −1.0639 | −1.0716 |
| $V_2$ | −1.0691 | −0.53974 | −1.1719 |
| $V_3$ | −1.1453 | −1.1562 | −1.1525 |

The range of locations of the b-spline patch control points affect the ray paths through the lens.

Figure 5:
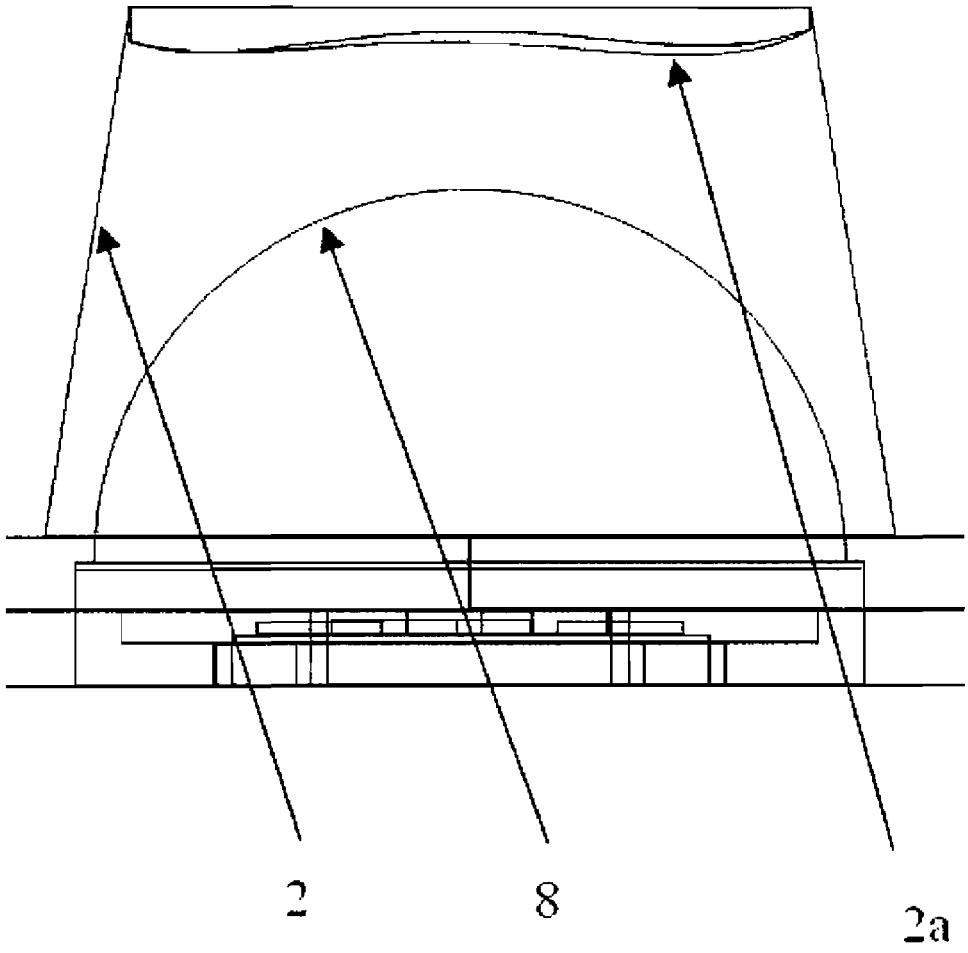
FIG. 5 is a side view of the inner collimation lens in the shape of a free form-b-spline patch.

FIG. 5 is an expanded view of the bottom portion of FIG. 4*a*, showing the light extraction lens 8, free-form spline patch lens 2*a*, and transmissive inner spline wall 2.

Referring to FIG. 4*a*, any light emerging from the light extraction lens 8 having a larger than desired off-axis angle will illuminate the interior of the transmissive inner spline wall 2 and then reflect upward through the function of the multi-lobe TIR collimation lens 3 ("collimation lens"). The purpose of the collimation lens 3 is to further improve the collimation of the light after it exits from the transmissive inner spline wall 2. The collimation lens 3 has an exit aperture at the top. The desired collimation must be balanced with the desired degree of color and intensity homogeneity for the intended application. In a preferred embodiment of the present invention, collimation resulting in a relatively narrow beam angle of 16° provides the preferred balance, largely limited by the diagonal distance from the center of the light engine array to the edge of the outer LED emitter, and the lambertian intensity distribution of the light sources themselves.

The collimation lens 3 is a diamond turned or micro-EDM ("electrical discharge machined") PMMA acrylic, glass or other optically transparent dielectric which collimates light through the means of total internal reflection. The cross-sectional shape of the collimation lens 3 includes lobes 3*a* (FIG. 4*b*) patterned to the placement of LEDs 1*a* within the light engine 1, and generally lacks rotational symmetry around the Z-axis. The lobes 3*a* are rounded protrusions in the cross-sectional shape of the collimation lens 3, which act to direct the off-axis light emerging from the light emitters, thereby yielding the efficiency required to increase on-axis illuminance.

The collimation lens 3 geometry required to redirect the light depends on the light fields emerging from each of the LED emitters 1*a*, which is dependent on the internal quantum structures and textures of the LED itself. Texturing of the physical top surface of the LED is used to increase external quantum efficiency. The shape of the collimation lens 3 is designed through light raytracing and geometry deformation iterations. The lobe shape of the entire collimation lens 3 is roughly defined by placing one rotationally symmetric collimator centered over each of the six emitters 1*a* and combining the shape (i.e., "solid geometry") of each collimator into one composite lens. The solid geometry of the composite lens is shaped to smoothly blend from the lobed structures 3*a* near the light engine 1, more conformal to LED 1*a* placement, to a circular shape at the exit aperture of the collimation lens 3. This progression in cross-sectional shapes is seen in FIGS. 4B-4F, at increasing heights in the Z-axis, blending from a multi-lobe structure at the bottom (FIG. 4*b*) to an approximately circular symmetry (FIG. 4*f*) at the exit aperture at the top. A circular exit aperture is preferred because continuing the lobes 3*a* to the exit aperture would degrade illumination uniformity over the beam width.

Referring to FIG. 4*a*, light directed upward by the multi-lobe collimation lens 3, and light that originally emerged from the free-form spline patch inner collimation lens 2*a* having a small angle between their direction of travel and the Z-axis, next pass through the primary mixing lenslet array 4, which is imprint molded into the collimation lens 3. The primary mixing lenslet array 4 operates by using the index of refraction difference between the immersing medium, in this case air, and the index of refraction of the lens to redistribute the color specific phase of the light emanating from the light engine 1. Lenslet arrays, including the primary mixing lenslet array 4, function best when the light incident on the lenslet array is collimated. Each of the lenslet arrays used in a preferred embodiment of the present invention, including the primary mixing lenslet array 4, provide a design individually tailored to the application of that lenslet array. Tailoring refers to the design procedure of determining the optimal amount of sag to disperse the light rays without backreflection TIR loss. For example a lenslet with a diameter of 2 mm which has a sag depth of 1 mm will have substantial light backreflection which produces loss of light transfer.

The primary mixing lenslet array 4 operates in a similar fashion to the compound eyes of a fly. The single lens of the human eye focuses light on the fovea of the retina. In contrast, the segmented compound eyes of a fly have a plurality of lenslets which focus light through many rhabdoms to photoreceptors. These structures or ommatidia are distributed over the compound eye. The fly's eye lenslet array 4 analogously makes the light from a single light source appear to be emanating from a plurality of light sources. The lenslets introduce micro-caustics, i.e., severe aberration-induced concentrations of light, which serve to disperse the light from the light sources to produce a more homogenous mixed light. Although the performance of imaging optics is improved by reducing aberrations, the lenslet array 4 acts generally to improve the color mixing by using non-imaging optics, in which homogenization of the emitted light is improved by introducing severe aberrations caused by the lenslets.

Figure 6A:
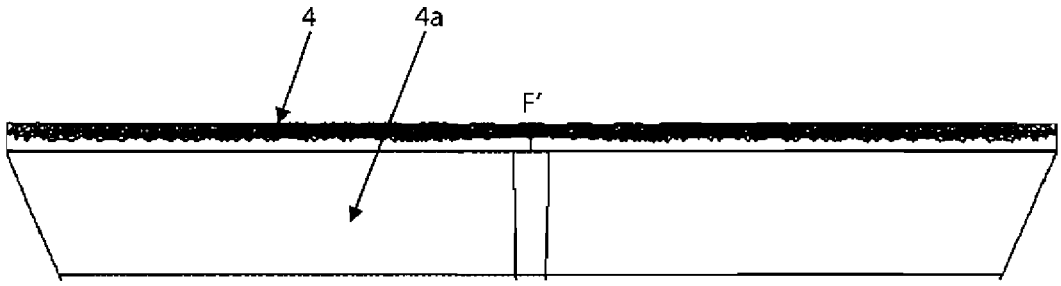
FIGS. 6A-6B are a side view and top view, respectively, of the first lenslet structure having hexagonal unit cells which are joined to produce a solid geometry and arrayed in a predetermined configuration to enhance color uniformity.
Figure 6B:
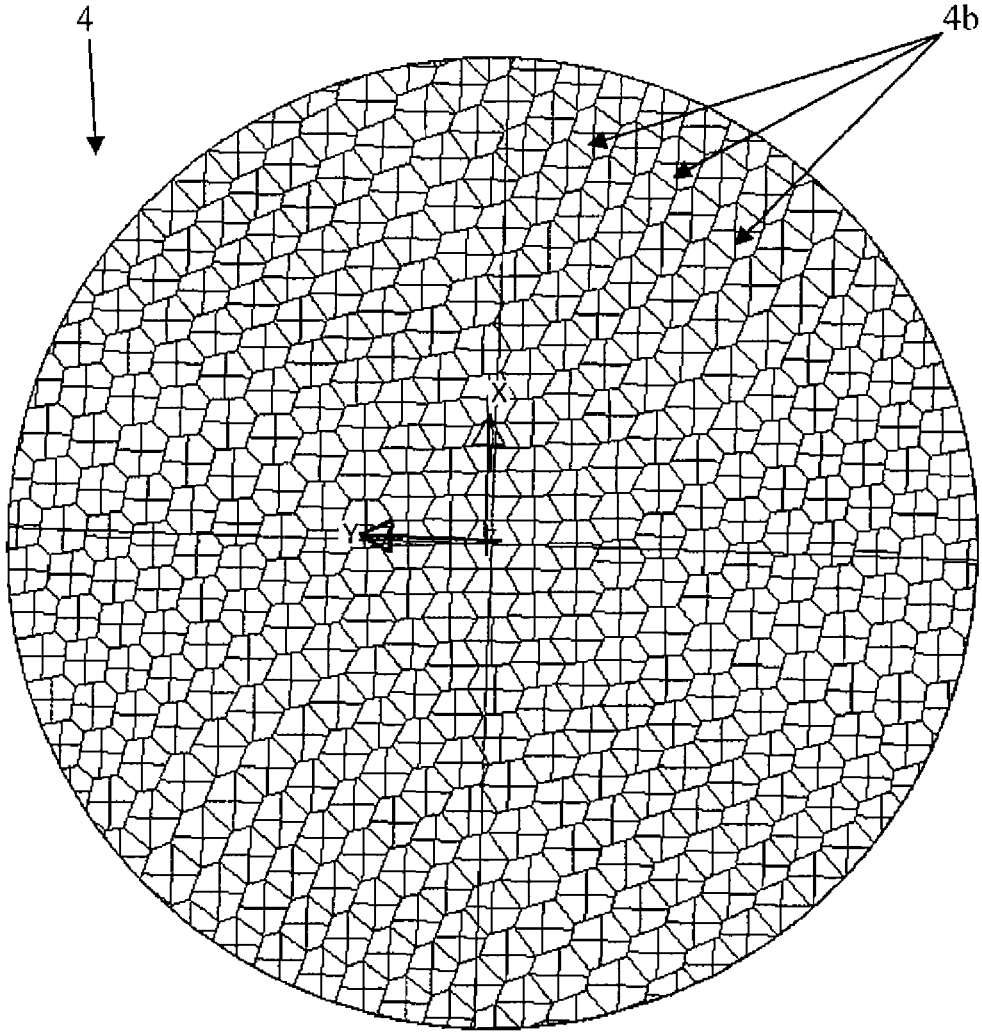
Figure 6C:
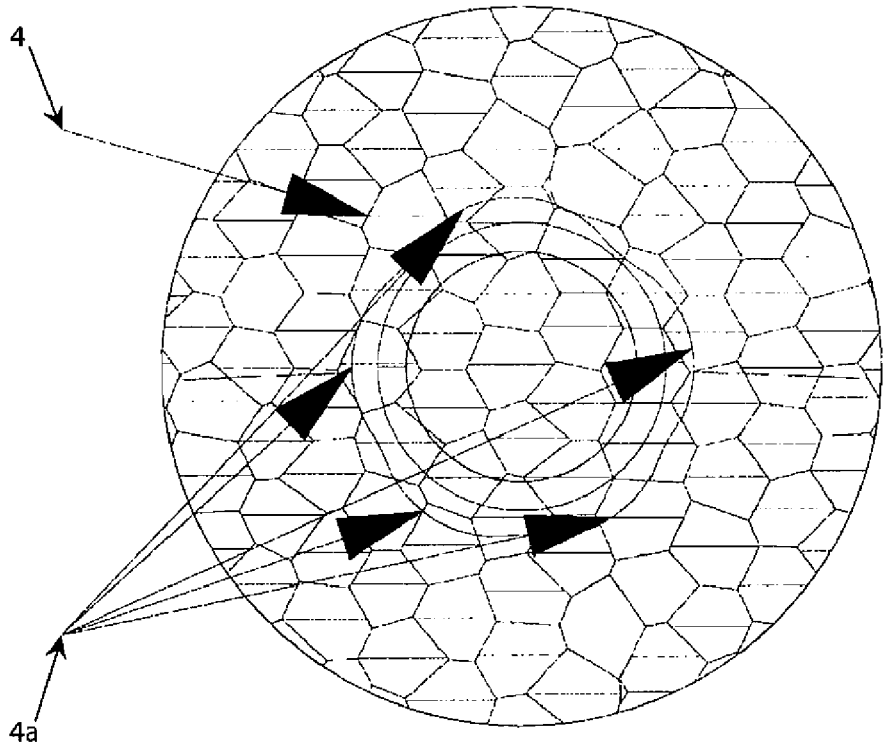
FIG. 6C is a top view of the first lenslet structure, further incorporating spherical lenses placed in randomized spatial locations.

FIG. 6*a* is an expanded side view of the top portion of the primary mixing lenslet array body 4*a*, showing the lenslet array 4 contained within the top surface region of the multi-lobe primary TIR collimation lens 3. FIG. 6*b* is a top view of the lenslet array 4, showing an embodiment of the arrangement of the individual lenslets 4*b* within the lenslet array 4 (for sake of clarity, not all individual lenslets 4*b* are labeled). Randomized spherical lenslets are a preferred surface shape, but an aspherical surface shape may also be used. Aspherics may contain conic constants, and other polynomial coefficients to finely control the shape of the generally spherical lens shape. A global Zernike deformation of the lenslet array 4 may also be applied to the exit surface. A Voronoi connectedness between the individual lenslets 4*b* provides spatial uniformity enhancement through local ray bundle dispersion. Local ray bundle dispersion is a characteristic wherein a group of light rays which are nearly parallel (i.e., forming a bundle of rays) impinge a surface nearly at the same location with nearly the same angle of incidence; however the reflection of individual light rays within the bundle from the surface is over a wide range of angles of reflection. Micro-surface roughness may be applied to sections of the lenslet array 4 in which the local surface perturbation can be described by a Gaussian, cosine, or periodic sine function. A preferred embodiment of the lenslet 4*b* placement is that the lenslets 4*b* may be placed in a spiral hex pattern as shown in FIG. 6*b*. Alternatively, the lenslets 4*b* may be placed in a randomized manner throughout the top surface area of the primary mixing lenslet array body 4*a*, as shown in FIG. 6*c*.

Figure 7A:
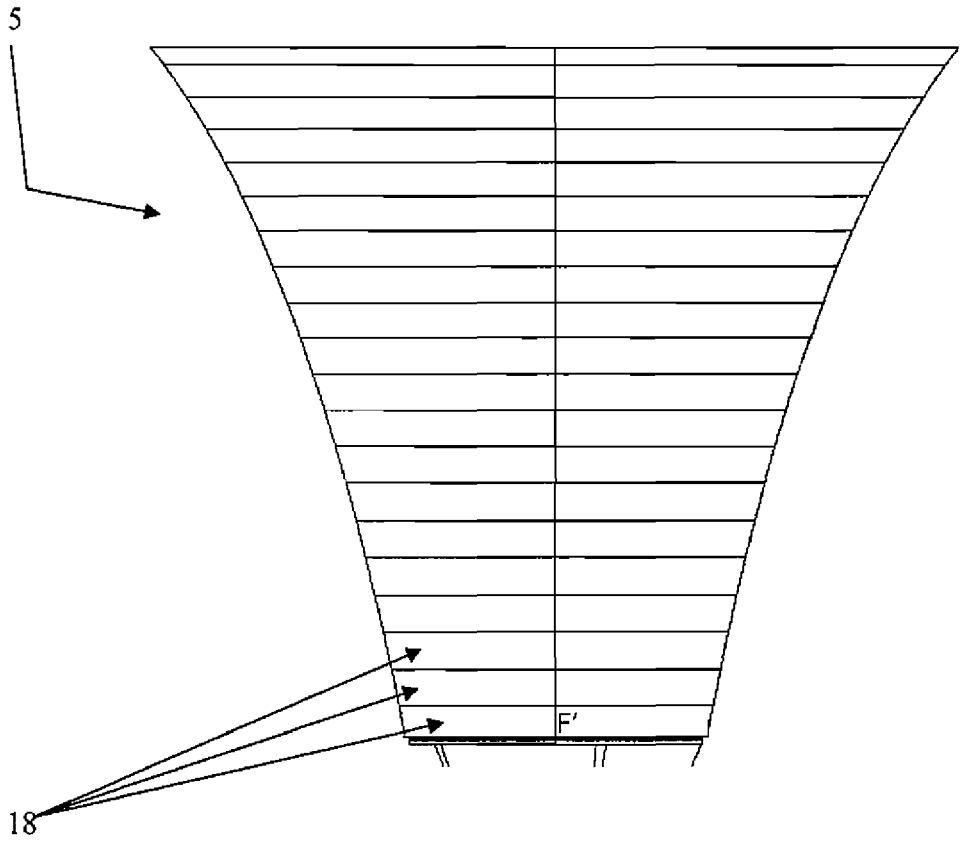
FIG. 7A is a side view of an embodiment of a reflector used for collimation having improved color uniformity in which uniformity enhancement devices may include texturing or ripples.

Referring to FIG. 3, light exiting from the primary mixing lenslet array 4 enters the spline profile reflector 5, having an entrance aperture at the bottom where light enters the spline profile reflector 5, and an exit aperture at the top where light exits the spline profile reflector 5. The spline profile reflector 5 also includes a ribbed structure embedded within the lower portion of its vertical side walls, near the entrance aperture. The ribbed structures are generally oriented in a vertical direction. The length, angle, depth and number of ribs are selected to optimize efficiency and color uniformity, and to provide the desired balance of collimation and uniformity. The optimal length of the ridged section of the spline profile reflector 5 is determined through optical raytracing in which a balance between uniformity and light transfer loss is achieved. Finer ridges produce greater uniformity at the expense of manufacturability. The ridge valleys may have a radius as small as 0.1 mm. FIG. 7*a* is a cross-sectional view in the X-Z plane of an exemplary calculated shape of the spline profile reflector 5. The spline profile reflector 5 is made up of a plurality of prescriptions, in which a prescription refers to a description of the shape (e.g., spline and its control points), structure (e.g., rib size and quantity), and texture (e.g., specular or diffuse) of a horizontal ring-shaped portion 18 of the spline profile reflector 5. At junctures between prescriptions, the inner surface of the spline profile reflector 5 is adapted to blend smoothly from one prescription to the next. Blending is performed through commonly available computer aided solid geometry tools, such as Solidworks, Pro/Engineer, or Rhino3D. FIG. 7*a* is shown with twenty prescriptions 18, but may generally range from 1-40 prescriptions. By convention, the first prescription is adjacent to the entrance aperture, and the last prescription is adjacent to the exit aperture.

Figure 7B:
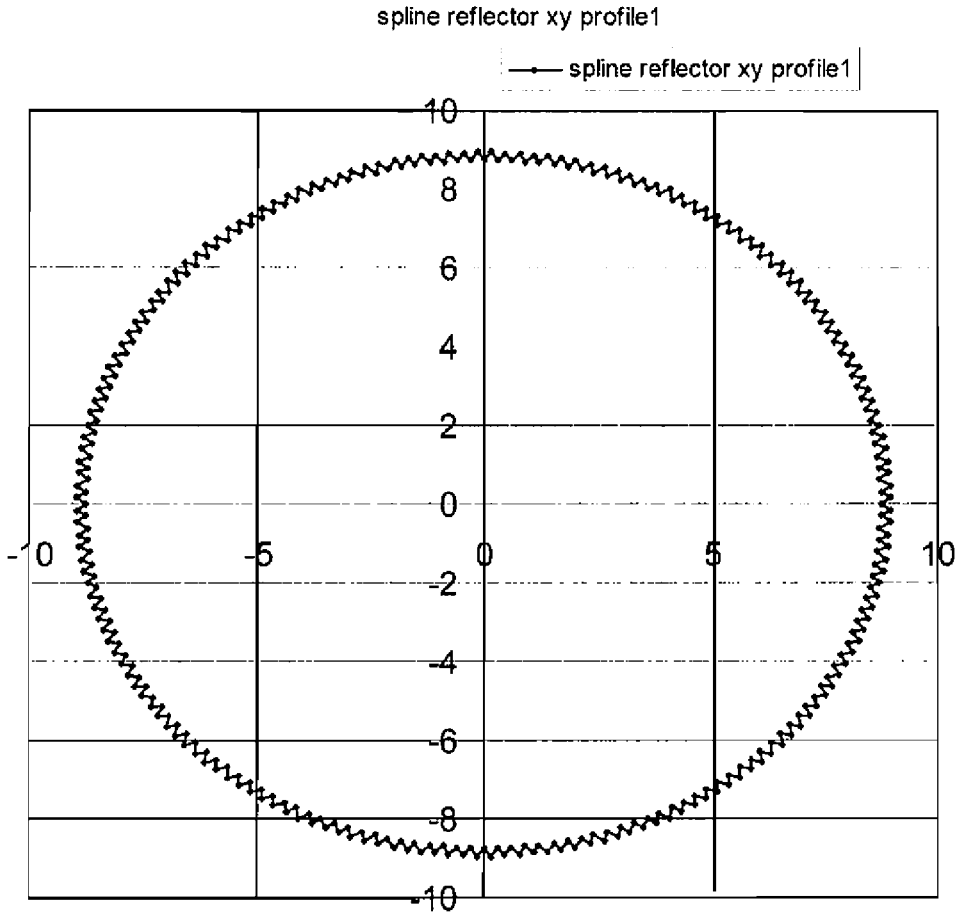
FIG. 7B is an XY cross section of the reflector of FIG. 7A having color uniformity enhancement ripples.

FIG. 7*b* is a cross-sectional view of the spline profile reflector 5 in the X-Y plane, showing the ripple in the first prescription. The ribbed structure tends to enhance the color uniformity of the reflected light by scattering the reflections in a wide angle in the X-Y plane. In the Z direction the ribbed structure helps collimates the light. The ripple angle defines the kurtosis (i.e., degree of peakedness) of the ridge with respect to a surface tangent vector in which a 90° ripple would constitute a square wave function with vertical walls and a 0° ripple would be perceived as smooth and unperturbed with respect to amplitude.

The ridge shape of the cross-section can be described mathematically by the equations:

$$f_1(x)=(\text{RADIUS})*\text{SIN}((360/(x)*((\text{INDEX})))*\pi/180)$$

$$f_1(y)=(\text{RADIUS})*\text{COS}((360/(y)*((\text{INDEX})))*\pi/180)$$

$$f_2(x)=(\text{RADIUS})+(\text{PEAK}))*\text{SIN}((((360/x)*(\text{INDEX}))+(360/x)/2)*(\pi/180))$$

$$f_2(y)=((\text{RADIUS})+(\text{PEAK}))*\text{COS}((((360/y)*(\text{INDEX}))+(360/y)/2)*(\pi/180))$$

$$\text{Rib angle: } \tan^{-1}((f_2(y)-f_1(y))/(f_2(x)-f_1(x)))*(180/\pi)$$

Where:

Radius=inner radius of profile

Num=number of peaks within 360°

Peak=peak amplitude of ridge wave

Index=Integer sequence 1, 2, 3, . . . Num

In the example of FIG. 7*a*, the height of the spline profile reflector 5 is 40 mm, but may generally range from 10 mm-100 mm. If the height is too small then the collimation will suffer, and if the height is too large then the compactness, cost, and manufacturability of the apparatus will suffer.

The ripple angle of the bottom prescription of the spline profile reflector 5 in FIG. 7*a* is 50 degrees, but may generally range from 0 degrees-90 degrees. The ripple angle generally decreases from a lower prescription to a higher prescription along the Z axis. A small ripple angle makes the reflective surface resemble a smooth surface, and if this occurs on a lower prescription then the color mixing will be degraded. If the ripple angle is too large, then some portion of the light will be reflected onto adjoining ripples, causing a loss in efficiency. Ripple angle generally cannot exceed 90 degrees. FIG. 7*b* shows a cross-sectional view of the first profile, near the bottom of the spline reflector 5, having a relatively large ripple angle of approximately 55 degrees.

The number of ripples in FIG. 7*a* of the bottom prescription of the spline profile reflector 5 is 180, but may generally range from 0 to 360. The number of ripples generally decreases from a lower prescription to a higher prescription along the Z axis. If the number of ripples is too small on a lower prescription, the color mixing will be degraded. If the number of ripples is too large, ripple size and spacing must decrease and the manufacturability of the apparatus will suffer. The ripple size and spacing is well above the size and spacing that would cause color separation due to diffraction effects.

The cross-sectional shape of the spline profile reflector 5 in the X-Y plane generally has an increasing radius with increasing height in the Z-axis because of the concave shape of the spline profile reflector 5. The radius in FIG. 7*a* in the X-Y plane at the bottom of the spline profile reflector 5 is 16.0 mm, but may generally range from a lower limit sufficient to enclose the top of the TIR collimation lens 3 to about 35 mm or more. The rippled entrance aperture of the spline reflector 5 is larger than the outside of the TIR primary collimation lens so as not to vignette (i.e., to clip) the light as it exits the lens. The radius in the X-Y plane at the top of the spline profile reflector 5 is 23.5 mm, but may generally range from a lower limit that is greater than the radius at the bottom of the spline profile reflector 5, to about 40 mm or more. If the exit radius of the spline reflector 5 is too small, the light exiting the TIR collimation lens will back propagate and induce loss of light transfer efficiency. If the radius is too large, then the compactness, cost, and manufacturability of the apparatus will suffer as well as the collimation of the optical system.

An optional feature of the spline profile reflector 5 is a faceted reflective surface area. Facets are common in illumination reflectors to homogenize the light and to remove concentration areas, however the facets may adversely affect the collimation of the light. Facets are defined by discretizing the continuous curve of the inner surface of spline profile reflector 5 in both the X-Y and X-Z cross sections in which the +Z direction represents the light path originating from the source and ending at the receiver or observation plane.

Figure 8:
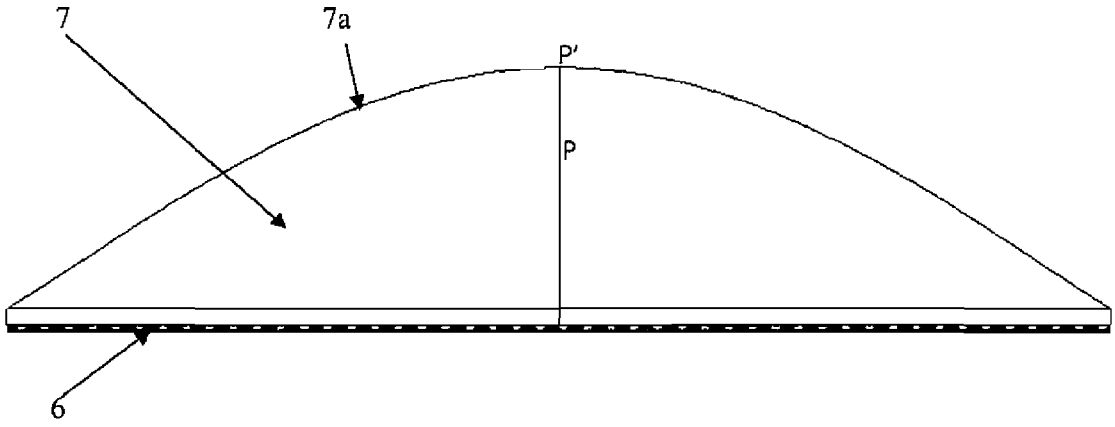
FIG. 8 is a side view of a secondary collimation lens having an aspheric polynomial sag profile.

Referring again to FIG. 3, light which exits the spline profile reflector 5 passes through a secondary lenslet array 6 and a secondary collimation lens 7. In one embodiment, the light first passes through the secondary lenslet array 6, followed by the secondary collimation lens 7, as shown in FIG. 3. FIG. 8 shows an expanded view of this embodiment, with the secondary lenslet array 6 beneath the secondary collimation lens 7.

In another embodiment, light exiting the spline profile reflector 5 first passes through the secondary collimation lens 7, and then through the secondary lenslet array 6.

Figure 9A:
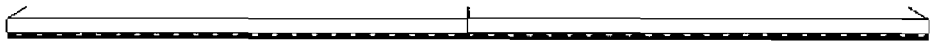
FIGS. 9A-9B are a side view and top view, respectively, of the secondary lenslet array having randomized spherical lenslets to improve color uniformity.
Figure 9B:
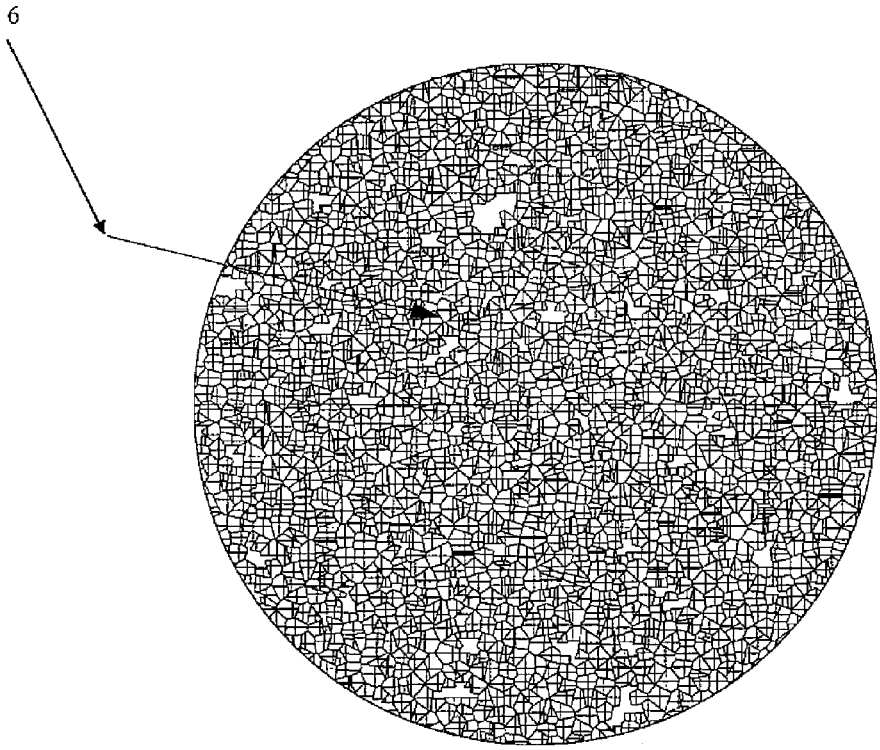

A top view of an embodiment of the secondary lenslet array 6 is shown in FIG. 9*b*. This embodiment is shown with a lenslet radius of curvature of 2.25 mm, thickness of 0.35 mm, and 2,401 lenslets. The lenslets cover the entire surface of the secondary lenslet array 6. The secondary lenslet array 6 at the exit of the spline profile reflector 5 is tailored to further increase color and intensity homogeneity, and works in tandem with the primary lenslet array 4. Randomized spherical lenslets are a preferred surface shape, but an aspherical surface shape may also be used. The individual lenslets surface shape may include radii, radii+conics, aspherics, or multi-order polynomials. The global surface of the lenslet array 6 may be perturbed by a general polynomial. The outer perimeter of secondary collimation lens 7 is circular in the illustrated embodiment. The thickness of the lenslets, the number of lenslets and their spatial locations may be optimized to provide sufficient uniformity at the highest collimation possible given the volume constraints.

The secondary collimation lens 7 further collimates the light and controls the edge of the beam or the degree to which the light falls off from the beam to field angle. The opposite surface 7*a* of the secondary collimation lens 7 has a profile (i.e., curved surface) described by an aspheric polynomial sag equation, and is rotationally symmetric around the Z-axis.

Figure 10:
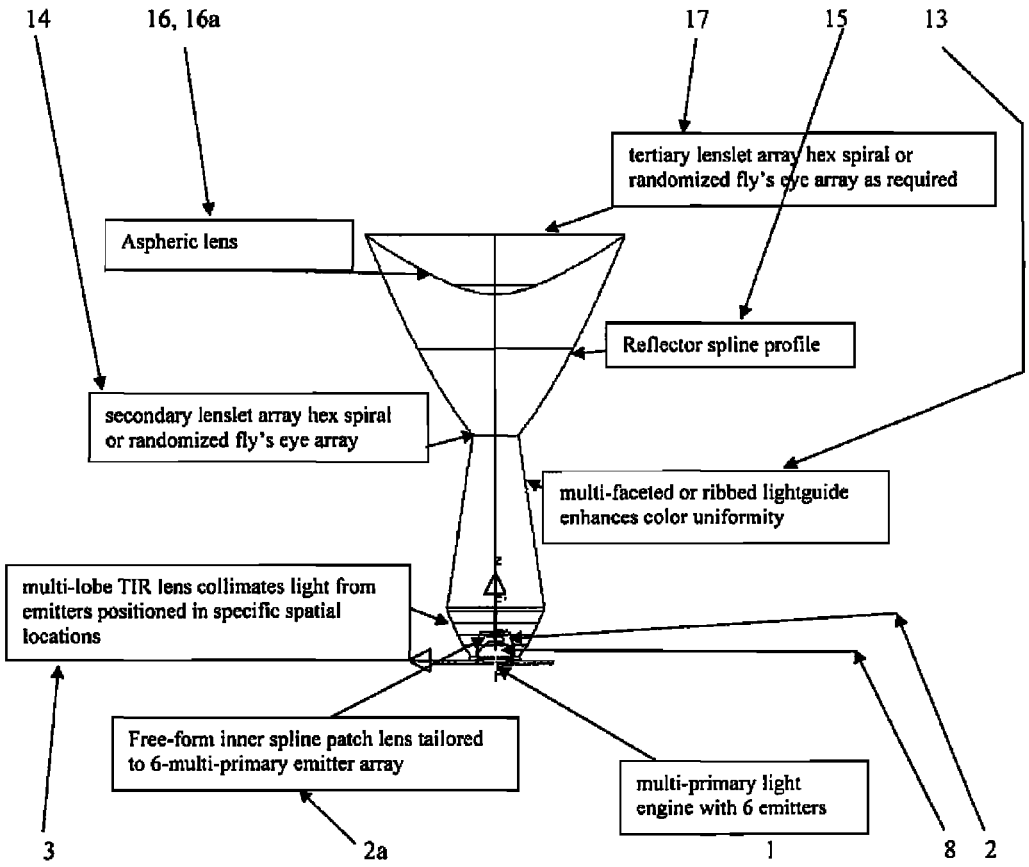
FIG. 10 is a side view of a second embodiment of the optic assembly.

FIG. 10 shows another embodiment of the entire optical assembly, which shares elements from the first embodiment of the optical assembly, including: light engine 1 having a plurality of LEDs; LED light extraction lens 8; transmissive inner spline wall 2; free-form spline patch inner lens 2*a*; and the multi-lobe TIR collimation lens 3. In addition, this alternate embodiment adds additional elements, including: lightguide 13; secondary lenslet array 14; reflector spline 15; aspheric lens 16 with curved surface 16*a*; and an optional tertiary lenslet array 17.

Figure 11:
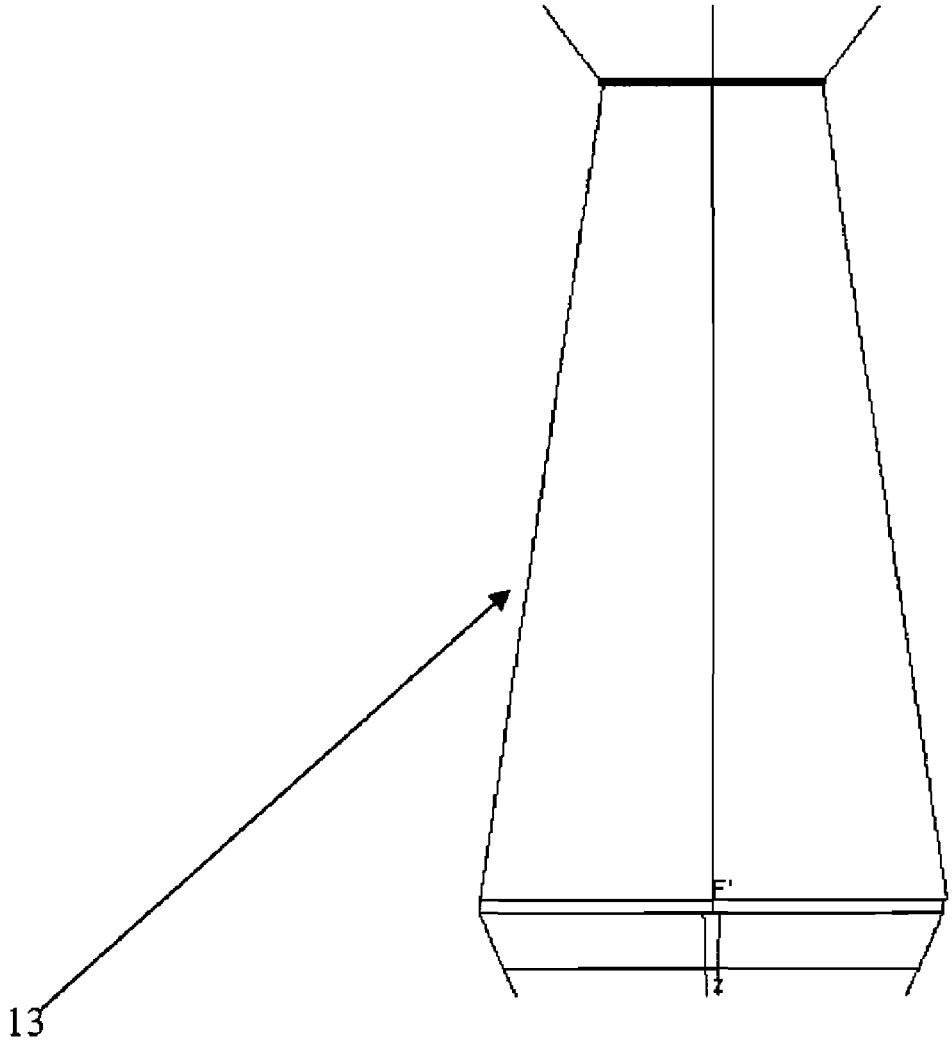
FIG. 11 is a side view of a light guide having an exterior ribbed wall surface to increase color uniformity of multi-primary light engine.

The profile of the lightguide 13 is a tapered shape, not comprised of a b-spline in the Z direction, and functions as a concentrator of the light from the entrance aperture to the smaller exit aperture. Lightguides which are unnecessarily long quench light transfer efficiency, which results in reduced on-axis intensity. The ridge pitch and angle to homogenize the light is preferably 45°-55° for a taper angle which takes an original source from the exit of the multi-lobe TIR collimation lens 3 to an exit aperture of 8 mm at the expense of increased light dispersion. Compensation for the increased light dispersion produced by the tapered lightguide 13 requires the additional reflector spline 15 to decrease light dispersion. In this embodiment, light exiting the primary multi-lobe collimation lens 3 passes through the lightguide 13, which enhances color uniformity. The light guide 13 is generally in the outer shape of a conic section, narrowing from the lower portion where the light enters the light guide 13, to the upper portion where the light exits the light guide. FIG. 11 shows an expanded view of the lightguide 13. The lightguide 13 has TIR surfaces and preferably includes ribbing at the exterior walls. The ribbing generally oriented in a vertical direction causes protrusions on the inner surface of the lightguide 13.

The quality of the polishing of the ridges has a impacts the efficiency of light transfer from the primary collimation lens 3 through the secondary lenslet array at the exit of the lightguide. A mirror polish with a surface texture of SPI-A1 is preferred to maximize light transfer efficiency. The lightguide should also be manufactured from a PMMA acrylic or other optically transparent dielectric which provide high internal transmittance over length, preferably >99%/2 mm. The degree of polishing of the mold for manufacturing the ridged lightguide affects the internal efficiency of the light paths as they strike the dielectric/air interface.

Figure 12A:
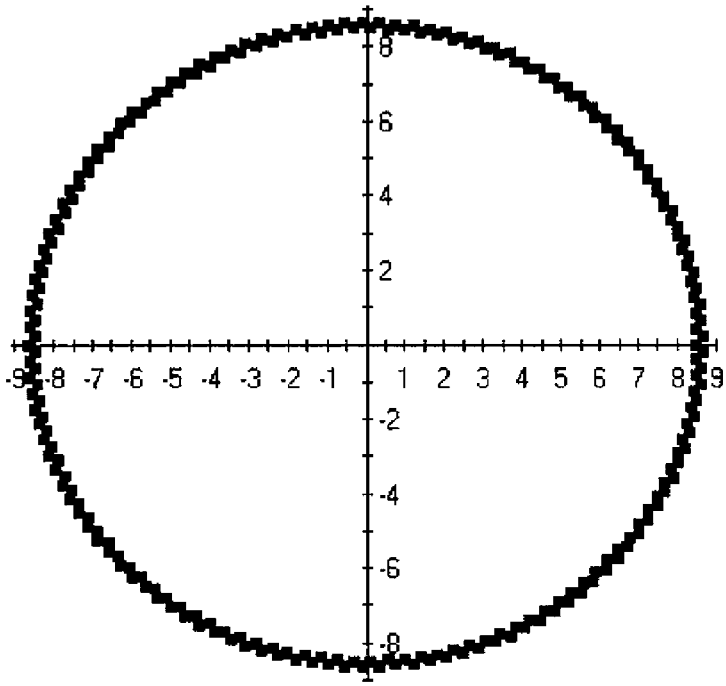
FIGS. 12A-12B are cross-sectional views of the light guide of FIG. 11, viewed at the light entrance (FIG. 12A) and at the light exit (FIG. 12B).
Figure 12B:
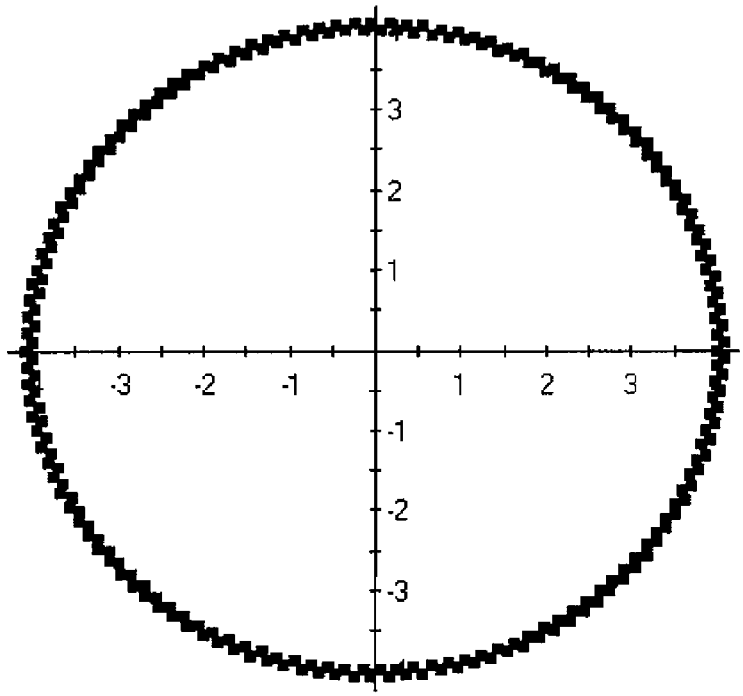

FIGS. 12A-12B show cross-sectional views of the lightguide 13 showing the ribbed structure of the walls for the profile near the entrance aperture (FIG. 12A) and exit aperture (FIG. 12B). The ribbing produces a sawtooth shape of the wall of the light-guide 13. The rib angle refers to the angle between adjacent segments of the sawtooth shape of the wall.

The rib angle varies from 0° (i.e., completely smooth) to 90° (i.e., square wave). The preferred design includes 120 ridges around the circumference of the lightguide, each having a rib angle of 50°-55°. The number of ridges does not change over the length of the lightguide 13. The inner and outer peaks of the ribbing form inner and outer envelopes of the cross-sectional shape.

Figure 13:
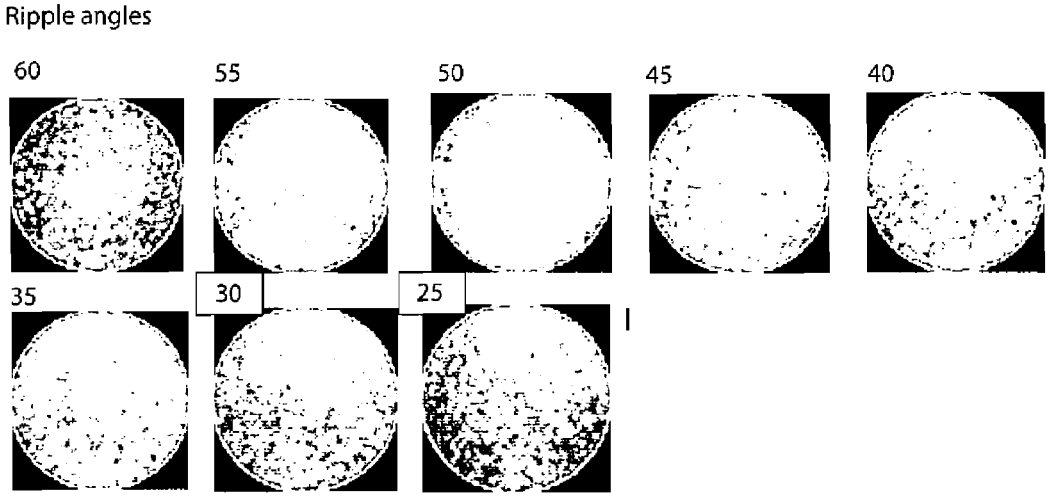
FIG. 13 is series of measured light beam uniformities associated with ribs in the light guide of varying degrees of ripple angle.

FIG. 13 shows simulated results of the effect of the rib angle upon the light uniformity at the exit of the lightguide 13. Light uniformity can be characterized by the standard deviation of the light illuminance over the surface of the exit aperture. A lower standard deviation produces greater uniformity of the light intensity. Greater uniformity of light intensity is desirable for this application. Results are presented in the top row from 60° to 40° at 5° increments, and from 35° to 25° in the bottom row. The best uniformity is associated with ripple angles of 50°-55°, but ripple angles of at least the range 40°-60° provide light uniformity that works well.

Figure 14:
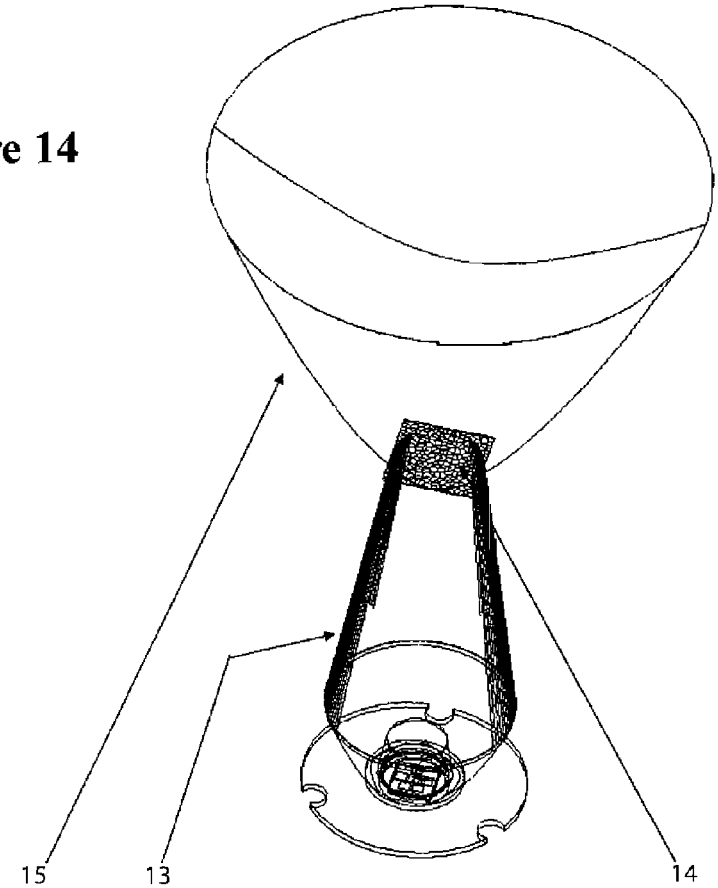
FIG. 14 is a perspective view of the second lenslet array attached to the exit port of a lightguide to improve color uniformity, the secondary reflector used to reduce intensity dispersion and the secondary lens used to provide beam edge control.

When the light leaves the light guide 13 it passes through a secondary lenslet array 14. FIG. 14 shows a perspective view of the secondary lenslet array 14. The individual lenslets may be shaped as hexagonal unit cells with spiral perturbation, in which the parametric equations perturbing the spacing conditions of the lenslets may be described by $x(t)=\exp(t)*\cos(t)$, $y(t)=\exp(t)*\sin(t)$. Alternatively, individual lenslets may be arranged in a shape-randomized fly's eye lenslet structures, which may include changes in the radius of curvature of the lenslets across the array, or variable conics and aspheric coefficients which vary between two bounds. Sag variation refers to the surface shape of the lenslets. The bounds of sag variation are the flat horizontal plane of the exit of the lightguide and the maximum thickness of the lenslets which does not cause the rays to recycle back to the source. The perimeter shape of the lenslets may be non-spherical. The placement and shape of the individual lenslets within the secondary lenslet array 14 are not necessarily the same as the placement and shape of the individual lenslets within any other lenslets in the invention, including the secondary lenslet array 14 of the first embodiment of the optical assembly. The purpose of the secondary lenslet array 14 is to further enhance the color uniformity of the light. The presence of the secondary lenslet array 14 at the end of the lightguide 13 reduces the length of lightguide 13 required to mix the light appropriately.

Figure 15:
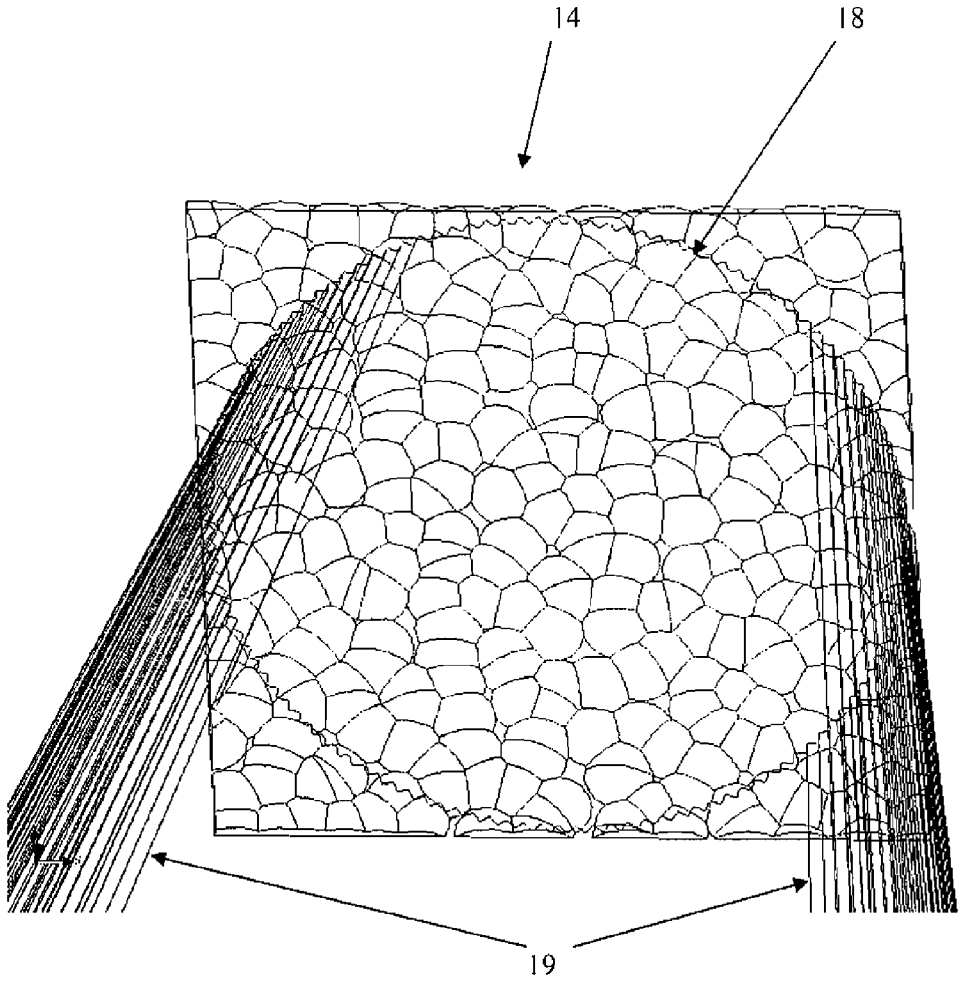
FIG. 15 is a top view of a lenslet array, located at the exit port of the ridged lightguide, having randomized lenslet size, shape and placement.

FIG. 15 is a perspective view of another embodiment of the secondary lenslet array 14, showing a spherical lenslet array with constant radius-randomized with respect to x, y placement. The entire surface area of the lenslet body is covered with lenslets. The square boundary represents the design space for the lenslet array pattern, and the sawtooth circular area 18 within the square boundary represents the secondary lenslet array 14. The edges of the square lenslet array aperture are trimmed away to match flush with the exit aperture ridges of the lightguide for manufacturing purposes. The ridges 19 around the circumference of the sawtooth circular area 18 represent the ribbing within the walls of lightguide 13.

After light passes through the secondary lenslet array 14, it passes to air and then reflects from reflector spline 15, which is a secondary collimation device, having a reflective inner surface with a cross-section in the X-Z plane in the shape of a concave b-spline. The reflector spline 15 works in tandem with the secondary collimation lens 16 (described below) to produce a light beam having high intensity and acceptable color homogeneity within the beam angle, and having a sharp drop-off in intensity outside the beam angle.

Light exiting the reflector spline 15 passes through the combination of the aspheric lens 16 and the optional tertiary lenslet array 17. The tertiary lenslet array 17, if present, decreases efficiency by approximately 6%. The aspheric lens 16 has two major surfaces: surface 16*a* is curved, with the curvature described by a sag profile. The second major surface of the aspheric lens 16 is substantially flat, and cooperatively contacts the tertiary lenslet array 17. It is preferred that light strike the aspheric lens sag first before the planar side in order to improve the edge cut-off of the beam of light. In one embodiment, shown in FIG. 10, light first passes through the aspheric lens 16 followed by the tertiary lenslet array 17. In this embodiment the sag profile of the aspheric lens 16, i.e., the curved surface, extends within the cavity formed by the reflector spline 15. In an alternate embodiment that is slightly less compact, the light first passes through the tertiary lenslet array 17, followed by the aspheric lens 16. The individual lenslets within the tertiary lenslet array 17 may be placed in a patterned arrangement or in a randomized arrangement.

Figure 16:
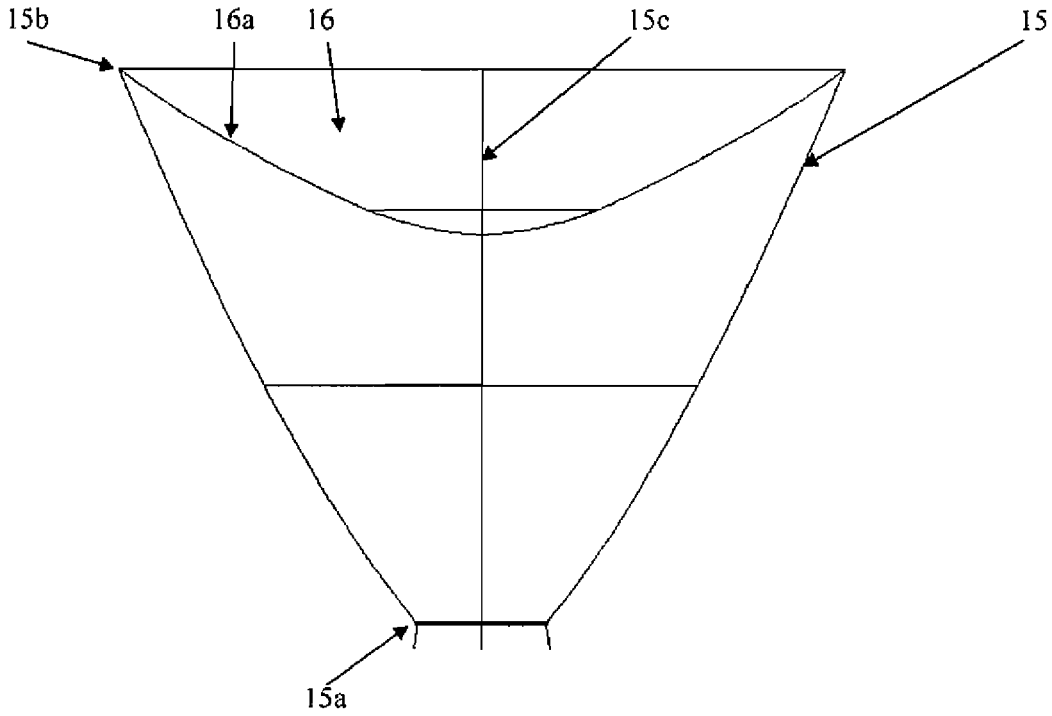
FIG. 16 is a side schematic view of the secondary collimation reflector and secondary edge control lens with convex side facing the incident light.

FIG. 16 is a detailed view of the secondary collimation reflector 15, having a cross-sectional shape in the X-Z plane of a b-spline. Secondary aspheric lens 16 is shown above the secondary collimation reflector 15. In this embodiment, the height of the secondary collimation reflector 15 may range from 10-100 mm (34 mm typical); the radius of the entrance aperture 15*a* at the bottom may range from 1-10 mm (4 mm typical); the radius of the exit aperture 15*b* at the top is larger than the radius of the entrance aperture 15*a*, and may range from 15-50 mm (22.7 mm typical). The vertical line 15*c* defines the optical axis of the secondary collimation reflector 15.

Figure 17:
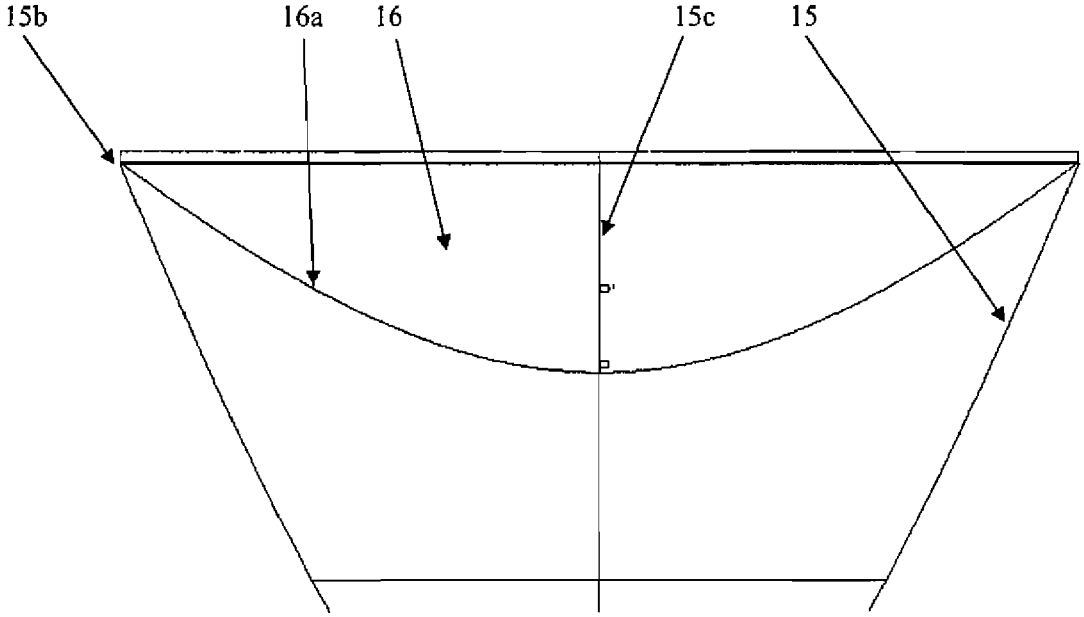
FIG. 17 is another side schematic view of the second collimation reflector and lens, enhanced to show the lens with an aspheric polynomial sag profile.

FIG. 17 is a detailed view of the secondary lens 16 with aspheric sag profile along its curved surface 16*a*. The radius of curvature of the curved surface 16*a* may range from a lower limit equal to the radius of the exit aperture 15*b* in the X-Y plane, with no upper limit (21 mm radius of curvature typical). The curved surface 16*a* in FIG. 17 is shown as a second order conic curve, but the curved surface 16*a* may be designed with additional aspheric coefficients in order to adjust the beam angle and the intensity distribution within the beam angle. Optionally, tertiary lenslet array 17 (not shown in FIG. 17) may be integrated with the secondary lens 16 to further enhance color uniformity.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

This application may disclose several numerical range limitations, which are intended as exemplary of one or more embodiments, and not limiting the present invention to any specific numerical range. Persons skilled in the art would recognize that the numerical ranges disclosed inherently support any range within the disclosed numerical ranges even though a precise range limitation is not stated verbatim in the specification because this invention can be practiced throughout the disclosed numerical ranges. The entire disclosure of the patents and publications referred in this application are hereby incorporated herein by reference.

The invention claimed is:

1. An optical assembly for producing light having improved collimation and color uniformity, comprising:

a light source comprising multiple light emitters arranged on a substrate;

an inner spline wall adjacent the substrate and enclosing the light source, wherein the inner spline wall is light transmissive;

an inner collimation lens positioned at a top of the inner spline wall, wherein the inner collimation lens collimates and redistributes light from the inner spline wall to improve color uniformity;

a TIR collimation lens having an upwardly-concave shape and oriented having a first axis perpendicular to a horizontal plane containing the light source, a bottom of the TIR collimation lens adjacent to the substrate and forming a TIR attachment contour enclosing the inner spline wall, and a top of the TIR collimation lens extending beyond the inner collimation lens, wherein the TIR collimation lens includes a total internal reflective surface for collimating light from the inner spline wall and inner collimation lens;

a primary lenslet array positioned at the top of the TIR collimation lens;

a spline profile reflector having a sidewall, an entrance aperture at a bottom of the sidewall, an exit aperture at a top of the sidewall and a reflective inner surface, wherein the entrance aperture is adjacent the top of the TIR collimation lens;

a secondary collimation lens adjacent a top of the spline profile reflector; and a secondary lenslet array adjacent the secondary collimation lens.

2. The optical assembly of claim 1, wherein the inner spline wall is shaped in accordance with the arrangement of the light emitters.

3. The optical assembly of claim 1, wherein the TIR attachment contour is shaped in accordance with the arrangement of the light emitters.

4. The optical assembly of claim 1, wherein at least a portion of the primary lenslet array comprises hexagonal lenslets with the primary lenslet array having a hexagonal perimeter.

5. The optical assembly of claim 4, wherein at least a portion of the hexagonal lenslets of the primary lenslet array are arranged in a hexagonal spiral pattern.

6. The optical assembly of claim 1, wherein at least a portion of the primary lenslet array comprises shape-randomized fly's eye lenslets.

7. The optical assembly of claim 1, wherein the spline profile reflector includes a plurality of embedded ribs of a predetermined size, wherein the ribs collimate and redistribute light from the multiple emitters to improve color uniformity.

8. The optical assembly of claim 7, wherein a depth of the plurality of ribs decreases from the bottom of the spline profile reflector to the top of the spline profile reflector.

9. The optical assembly of claim 1, wherein the inner surface of the spline profile reflector is faceted.

10. The optical assembly of claim 1, wherein at least a portion of the secondary lenslet array comprises hexagonal lenslets with the secondary lenslet array having a hexagonal perimeter.

11. The optical assembly of claim 10, wherein at least a portion of the hexagonal lenslets of the secondary lenslet array are arranged in a hexagonal spiral pattern.

12. The optical assembly of claim 1, wherein at least a portion of the secondary lenslet array comprises shape-randomized fly's eye lenslets.

13. The optical assembly of claim 1, wherein the secondary lenslet array overlies the secondary collimation lens.

14. The optical assembly of claim 1, wherein the secondary collimation lens overlies the secondary lenslet array.

15. The optical assembly of claim 1, wherein the secondary collimation lens has a surface shape described by an aspheric polynomial sag equation.

16. An optical assembly for producing light having improved collimation and color uniformity, comprising:

a light source comprising multiple light emitters on a substrate;

an inner spline wall adjacent the substrate and enclosing the light source, wherein the inner spline wall is light transmissive and includes a bottom adjacent the substrate and a top at an opposite end of the inner spline wall;

an inner collimation lens positioned at the top of the inner spline wall, wherein the inner collimation lens collimates and redistributes light from the multiple emitters to improve color uniformity;

a TIR collimation lens having an upwardly-concave shape and oriented having a first axis perpendicular to a horizontal plane containing the light source, a bottom of the TIR collimation lens adjacent the substrate and forming a TIR attachment contour enclosing the inner collimation lens, and a top of the TIR collimation lens extending beyond the inner collimation lens, wherein the TIR collimation lens includes a total internal reflective surface for collimating light from the inner spline wall and inner collimation lens;

a lightguide having a sidewall, an entrance aperture at a bottom of the sidewall and adjacent the TIR collimation lens, an exit aperture at a top of the sidewall and a reflective inner surface;

a secondary lenslet array positioned at the exit aperture of the lightguide;

a reflector spline having a reflector spline entrance aperture; and a reflector spline exit aperture, wherein the reflector spline entrance aperture is adjacent the exit aperture of the lightguide, and the reflector spline entrance aperture overlies the secondary lenslet array; and an aspheric lens adjacent the reflector spline exit aperture.

17. The optical assembly of claim 16, wherein the inner spline wall is shaped in accordance with an arrangement of the light emitters.

18. The optical assembly of claim 16, wherein the TIR collimation lens attachment contour is shaped in accordance with an arrangement of the light emitters.

19. The optical assembly of claim 16, wherein at least a portion of the secondary lenslet array comprises hexagonal lenslets with the secondary lenslet array having a hexagonal perimeter.

20. The optical assembly of claim 19, wherein at least a portion of the hexagonal lenslets of the secondary lenslet array are arranged in a hexagonal spiral pattern.

21. The optical assembly of claim 16, wherein at least a portion of the secondary lenslet array comprises shape-randomized fly's eye lenslets.

22. The optical assembly of claim 16, further comprising a tertiary lenslet array at the reflector spline exit aperture.

23. A method for producing light having improved collimation and color uniformity, comprising the following steps:

providing a light source comprising multiple light emitters arranged on a substrate;

redistributing at least a portion of the light from the light source with an inner spline wall adjacent the substrate and enclosing the light source, wherein the inner spline wall is light transmissive;

collimating and redistributing at least a portion of the light from the inner spline wall with an inner collimation lens positioned at a top of the inner spline wall, wherein the inner collimation lens collimates and redistributes light from the multiple emitters to improve color uniformity;

collimating the light with a TIR collimation lens having an upwardly-concave shape and oriented having a first axis perpendicular to a horizontal plane containing the light source, a bottom of the TIR collimation lens adjacent the substrate and forming a TIR attachment contour enclosing the inner spline wall, and a top of the TIR collimation lens extending beyond the inner collimation lens, wherein the TIR collimation lens includes a total internal reflective surface for collimating light from the inner spline wall and inner collimation lens;

redistributing the light collimated by the TIR collimation lens with a primary lenslet array positioned at the top of the TIR collimation lens;

redistributing further the light from the primary lenslet array with a spline profile reflector having a sidewall, an entrance aperture at a bottom of the sidewall, an exit aperture at a top of the sidewall and a reflective inner surface, wherein the entrance aperture is adjacent the top of the TIR collimation lens;

collimating further the light from the secondary collimation lens with a secondary collimation lens adjacent the top of the spline profile reflector; and redistributing further the light with a secondary lenslet array adjacent the secondary collimation lens.

24. A method for producing light having improved collimation and color uniformity, comprising the following steps:

providing a light source comprising multiple light emitters arranged on a substrate;

redistributing at least a portion of the light from the light source with an inner spline wall adjacent the substrate and enclosing the light source, wherein the inner spline wall is light transmissive;

collimating and redistributing at least a portion of the light from the inner spline wall with an inner collimation lens positioned at a top of the inner spline wall, wherein the inner collimation lens collimates and redistributes light from the multiple emitters to improve color uniformity;

collimating the light with a TIR collimation lens having an upwardly-concave shape and oriented having a first axis perpendicular to a horizontal plane containing the light source, a bottom of the TIR collimation lens adjacent the substrate and forming a TIR attachment contour enclosing the inner spline wall, and a top of the TIR collimation lens extending beyond the inner collimation lens, wherein the TIR collimation lens includes a total internal reflective surface for collimating light from the inner spline wall and inner collimation lens;

concentrating light from the TIR collimation lens with a lightguide having a sidewall, an entrance aperture at a bottom of the sidewall and adjacent to the TIR collimation lens, an exit aperture at a top of the sidewall and a reflective inner surface;

redistributing light from the lightguide with a secondary lenslet array positioned at the exit aperture of the lightguide;

collimating and redistributing light from the secondary lenslet array with a reflector spline having a reflector spline entrance aperture; and a reflector spline exit aperture, wherein the reflector spline entrance aperture is adjacent the exit aperture of the lightguide, and the reflector spline entrance aperture overlies the secondary lenslet array; and collimating light from the reflector spline with an aspheric lens adjacent the reflector spline exit aperture.

25. An optical assembly for producing light having improved collimation and color uniformity, comprising:

an inner spline wall having a curved lower edge forming an opening, wherein the inner spline wall is light transmissive;

an inner collimation lens positioned at a top of the inner spline wall, wherein the inner collimation lens collimates and redistributes light from within the inner spline wall;

a TIR collimation lens having an upwardly-concave shape and oriented having a first axis perpendicular to a horizontal plane containing the light source, a bottom of the TIR collimation lens adjacent to an opening in the inner spline wall, and a top of the TIR collimation lens extending beyond the inner collimation lens, wherein the TIR collimation lens includes a total internal reflective surface for collimating light from the inner spline wall and inner collimation lens;

a primary lenslet array positioned at the top of the TIR collimation lens;

a spline profile reflector having a sidewall, an entrance aperture at a bottom of the sidewall, an exit aperture at a top of the sidewall and a reflective inner surface, wherein the entrance aperture is adjacent the top of the TIR collimation lens;

a secondary collimation lens adjacent the top of the spline profile reflector; and a secondary lenslet array adjacent the secondary collimation lens.

* * * * *